United States Patent [19]

Kaptein

[11] Patent Number: 4,787,605

[45] Date of Patent: Nov. 29, 1988

[54] COOLABLE FURNACE WALL STRUCTURE

[75] Inventor: Frank Kaptein, Beverwijk, Netherlands

[73] Assignee: Hoogovens Groep B.V., IJmuiden, Netherlands

[21] Appl. No.: 101,440

[22] Filed: Sep. 28, 1987

[30] Foreign Application Priority Data

Oct. 3, 1986 [NL] Netherlands ..... 02492/86

[51] Int. Cl.[4] ..... C21B 7/10

[52] U.S. Cl. ..... 266/194; 266/193; 122/6 B

[58] Field of Search ..... 266/190, 193, 194, 197, 266/287, 280; 432/83; 122/6 A, 6 B

[56] References Cited

U.S. PATENT DOCUMENTS

| | | | |
|---|---|---|---|
| 2,991,061 | 7/1961 | Boron | 266/193 |
| 3,241,528 | 3/1966 | Loecher | 266/193 |
| 4,619,442 | 10/1986 | Hattori et al. | 122/6 B |

FOREIGN PATENT DOCUMENTS

| | | | |
|---|---|---|---|
| 0655249 | 1/1938 | Fed. Rep. of Germany . | |
| 0957758 | 2/1957 | Fed. Rep. of Germany . | |
| 1013680 | 8/1957 | Fed. Rep. of Germany . | |
| 2097192 | 3/1972 | France . | |
| 2533306 | 3/1984 | France . | |
| 0041817 | 4/1972 | Japan | 266/193 |
| 7601582 | 8/1977 | Netherlands . | |
| 2023783 | 1/1980 | United Kingdom . | |

*Primary Examiner*—L. Dewayne Rutledge
*Assistant Examiner*—S. Kastler
*Attorney, Agent, or Firm*—Stevens, Davis, Miller & Mosher

[57] ABSTRACT

A coolable furnace wall structure has a steel shell and a refractory lining of the shell. Spaced apart openings through the shell, correspond with recesses in the lining which have a transverse width which increases away from the shell. In each opening and corresponding recess is an assembly of at least to hollow cooling plates which are removably connected to the shell. A first one of the cooling plates has a transverse width which does not increase away from the shell opening whereby that cooling plate can be removed first from the assembly through the opening and at least one other cooling plate of the assembly has a maximum transverse width which permits its removal through the opening after removal of the first plate.

12 Claims, 3 Drawing Sheets

COOLABLE FURNACE WALL STRUCTURE

BACKGROUND OF THE INVENTION

1. FIELD OF THE INVENTION

The invention relates to a coolable furnace wall structure having a steel shell and a refractory lining inside the shell, for example for a blast furnace.

2. DESCRIPTION OF THE PRIOR ART

To cool such a furnace wall, it is known to insert cooling plates into the wall. At regular intervals, openings are made in the shell and corresponding recesses are provided behind them in the lining, into which the cooling plates, which are hollow plate-shaped elements, extend. The cooling plates are removably connected to the shell and fitted with supply and discharge openings for cooling liquid. Such a wall structure is often used in shaft furnaces, in particular in blast furnaces, but the applicability of the present invention is not limited to these installations.

In particular, in a blast furnace the cooling plates are used to remove heat from the inside of the furnace, in order to prevent overheating of the lining and the steel shell. In addition, the cooling plates, which mostly consist of cast copper, have a supporting function, in order to limit the relative movement of the lining and the shell.

In modern high-capacity blast furnaces which are operated under over-pressure, the cooling plates need to be fixed to the shell so that they are gastight, for which purpose either flanged connections or welded connections are used.

One drawback to the known structure described above is that the shell is weakened at many points by the openings. The structure which is often used in practice and is sufficiently strong, is the result of balancing on the one hand the costs of a much thicker shell structure and on the other hand the use of fewer cooling plates, which means that less cooling than ideally is desired has to suffice. Particularly where a blast furnace is operated at high production rate, the cooling capacity required makes an extra thick and hence expensive shell structure necessary. When modernizing an existing blast furnace installation, one is very often tied to the shell structure present. An increase in the cooling capacity by the fitting of extra cooling plates has the drawback that this would result in an inadmissible weakening of the shell.

SUMMARY OF THE INVENTION

The invention therefore primarily has the object of providing a furnace wall structure in which the thickness of the steel shell can be kept relatively small.

A further object of the invention is to provide the possibility in an existing blast furnace of increasing the cooling capacity without increasing shell thickness.

Another, subsidiary object of the invention is, while increasing the cooling capacity, to reduce the quantity of copper required for the cooling plates.

According to the invention in the furnace wall structure at least some of the recesses widen in the direction away from the shell and in each such recess there is an assembly of at least two cooling plates. At least a first one of the cooling plates does not increase in thickness away from the shell, i.e. has parallel or slightly tapering side walls. Each of the remaining cooling plates has a maximum width which makes it possible for the plate to be removed through the opening in the shell to the outside after the first cooling plate.

This structure has the following advantages. In existing furnaces the cooling capacity may be increased, without the shell having to be reinforced. In designing a new furnace for a required cooling capacity, it is possible to use a thinner shell than hitherto employed. In addition, it is found that a smaller quantity of copper is required for the cooling plates.

The widening shape of the recesses can for example have the form of a truncated isosceles right-angled pyramid, of which the upper surface is formed by the opening in the shell. An isosceles right-angled pyramid is to be understood as a pyramid with a base in the form of a square, on which the side faces are in the form of isosceles triangles. The cooling plates must be fitted into this space in a suitable way, but it must also be possible to remove them again. To this end a first cooling plate is fitted with parallel or slightly tapering side walls.

The shape of the widening recess is limited by the constructing of the refractory lining. A widening shape in the form of a truncated pyramid requires a very complicated method of construction. A simpler structure is obtained if the widening shape is that of a trapezium in the widthways direction with the narrow base located at the shell opening. In such an opening at least two cooling plates are fitted. In order to fit these plates in the opening in a suitable way, the dimensions of the cooling plates which fit into the same opening should be adapted very accurately to each other. If the fit is bad, the cooling capacity is reduced. The use of large numbers of cooling plates also means that more inlet and outlet pipes have to be used, which results in increased costs.

The advantages of the invention can be obtained in a simple way and at limited costs, where the assembly consists of only two cooling plates.

Modern furnaces are operated at high pressure, which requires a gas-tight seal of the shell. The cooling plates, which project into the recesses behind the openings in the shell, must be connected to the shell so that a gas-tight seal can be obtained. It is not practical to weld copper cooling plates onto the steel shell. It is also not practical to weld together the adjacent cooling plates.

These problems are however solved if he cooling plates each have a steel band cast around the rear (outer) end, and the band is connected to the shell via a single welded-on cover plate for the assembly, and if the adjoining portions of the steel bands for the different cooling plates are welded directly to each other.

When welding together the adjacent cooling plates, the adhesion of the steel band to the copper can be affected. This can be avoided if the adjoining parts of the steel bands for adjacent cooling plates each have a projection to the rear. As the cooling plates usually have rounded corners, it would seem that gas-tight welding at the point where the cooling plates and the cover plate join causes difficulties. This can be improved by welding additional sealing strips on the cover plates and to the steel bands where the adjoining cooling plates touch each other. This further has the advantage that welding can take place more quickly.

It is preferred that the first cooling plate contains a liquid passage running singly out and back, and the or each said other cooling plate contains a liquid passage running doubly out and back.

It is preferable for the two cooling plates with their inlets and outlets to be coupled so that the flow through them is in series. Suitably a coupling pipe which connects the cooling plates is attached on either side of the inlet and outlet pipes to the assembly of the two cooling plates, e.g. the inlet and outlet openings are in a row and the connecting pipe joins the endmost openings. The extra pipework required can thus be limited.

The removal of cooling plates from the recesses can encounter difficulties because of the sometimes close fit. Removal can be facilitated by fitting the cooling plates with eyes for disassembly projecting outwardly. It is preferable for the eye for disassembly for the said first cooling plate in a projection cast on and extending transversely to the surface of the cover plate, while the eyes for the said second cooling plate are formed in opposed projections on the steel band.

The invention also extends to the assembly of cooling plates for use in the furnace wall structure in accordance with the invention.

BRIEF INTRODUCTION OF THE DRAWINGS

A preferred embodiment of the invention will now be described by way of non-limitative example with reference to the accompanying drawings, in which:

FIG. 1 shows part of a cross-section through one furnace wall structure in accordance with the invention, at the level of some of the recesses, FIG. 2 shows a recess with the cooling plates inside it in cross-section, FIG. 3 is a front view of the cooling lates and a cross-section on line A—A of this front view, and FIG. 4 is a view in perspective of the cooling plates in the recess.

DESCRIPTION OF THE PREFERRED EMBODIMENT

Figure 1:
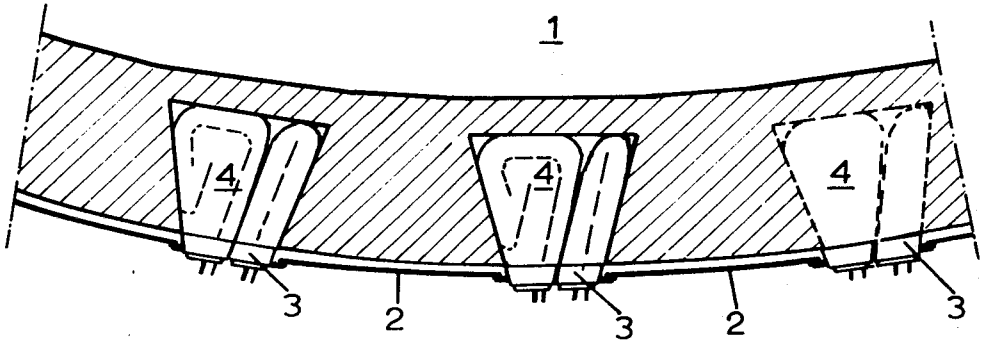

FIG. 1 shows a furnace wall structure consisting of a refractory lining 1 and a shell 2. In the shell 2 there are openings 3 present at a number of places and for each opening a corresponding recess 4 in the refractory lining 1. The recess 4 has a trapezium-shaped widening form in the direction from the opening 3 into the refractory lining 1, as seen in horizontal section. The upper and lower boundaries of the recess are parallel.

Figure 2:
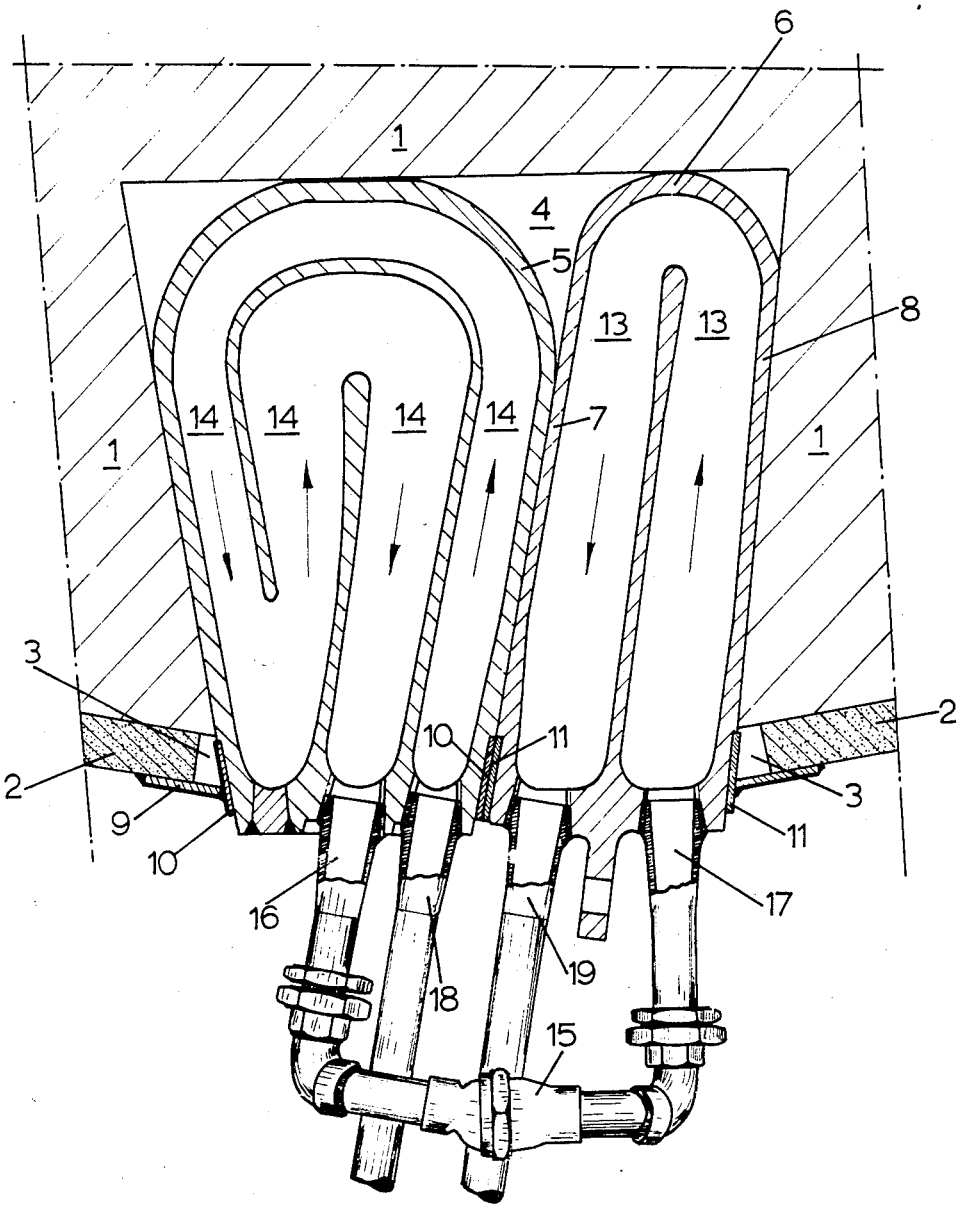

FIG. 2 shows hat in each recess 4, an assembly of two copper cooling plates 5,6 is fitted which largely fills the recess 4. FIG. 2 shows the use of two cooling plates, but the invention is not limited to this number. A first cooling plate 6 has parallel or slightly tapering side walls 7,8 so that this cooling plate 6 can be easily pulled out of the recess 4. The greatest width of the other cooling plate 5 is such that it can still be passed through the opening 3, after the cooling plate 6 is removed.

Figure 3:
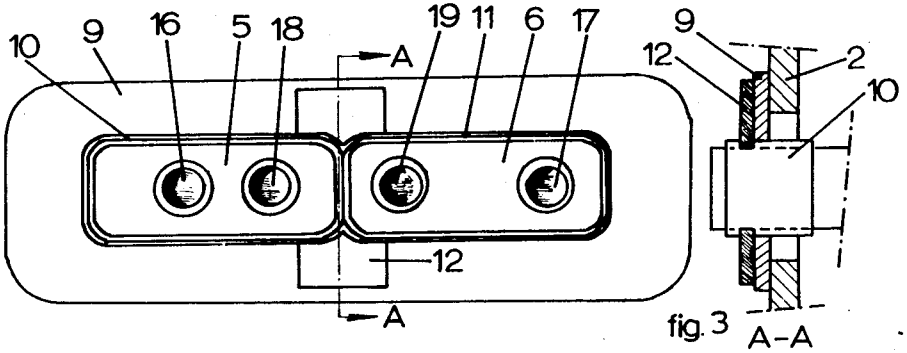

When the cooling plates 5,6 are fitted in the recess 4, the connection of the plates to the furnace shell and the closing of the opening 3 is achieved by a cover plate 9 which is welded to the shell 2 and to a steel band 10, which is cast onto the cooling plate 5, and to a steel band 11 cast onto the cooling plate 6 (see also FIG. 3). In addition, where the two cooling plates 5,6 adjoin, a seal strip 12 is welded onto the cover plate 9 and the steel bands 10 and 11 in order to obtain a good gas-tight seal, and the steel bands 10 and 11 are welded to each other where they adjoin for this same purpose (see below).

As shown in FIG. 2, the first removed cooling plate 6 has a coolant liquid passage 13 running once out and back and the other cooling plate 5 is fitted with a coolant liquid passage 14 running twice out and back, i.e. with two outward runs and two inward runs.

FIG. 2 also shows the coupling pipe 15 which couples the discharge outlet 16 of the cooling plate 5 with the supply inlet 17 of the cooling plate 6. This inlet 17 and outlet 16 lie at the ends of the row of openings including also the supply inlet 18 to the plate 5 and the discharge outlet 19 from the plate 6. Via this coupling pipe 15 the liquid flows through the cooling plates 5 and 6 in series. The assembly of cooling plates 5,6 can be connected via the inlet 18 and the outlet 19 to the other parts of the cooling installation not shown, in the same manner as a conventional cooling plate.

Figure 4:
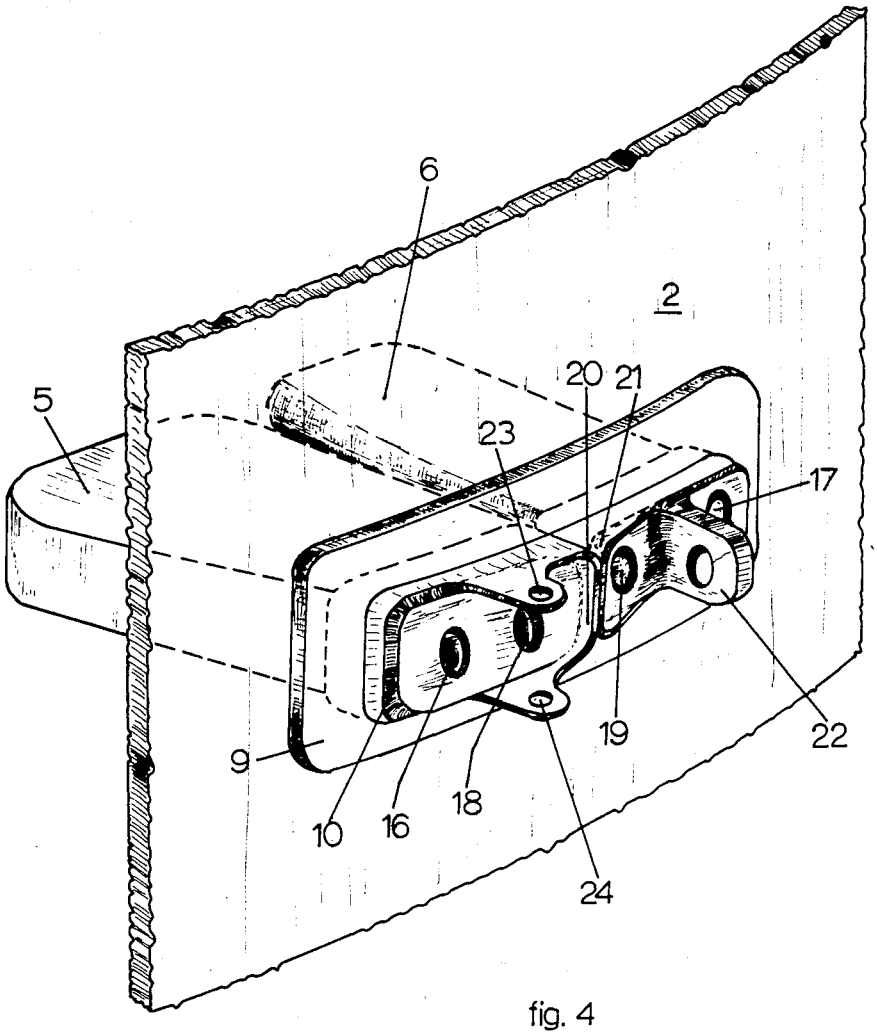

FIG. 4 shows that, at the point where the steel band 10 of the cooling plate 5 and the steel band 11 of the cooling plate 6 touch each other, these steel bands 10,11 each have an outward projection or flange 20,21. The welding together of the steel bands 10 and 11 can thus be carried out at these projections 20,21 without any danger of loosening of the connection of the steel bands and copper, of which the cooling plates 5,6 consist. The cooling plate 6 is fitted with an eye 22 for disassembly in a projection cast on at right-angles to the surface of the cover plate 9, and cooling plate 5 has two eyes for disassembly in the form of drilled holes 23,24 in outward projections of the steel band 10.

To give one non-limitative example of the application of the invention, in a blast furnace with a hearth diameter of about 11 m, in which each opening 3 in the shell was 500 mm wide, it is possible to achieve a cooling capacity corresponding to an opening width of 636 mm in accordance with a conventional design. This increased cooling capacity can be achieved with a shell thickness which was 21% less than normal.

A further advantage is that, with respect to the conventional design, 18% less copper was necessary for the cooling plates and that for the cover plates in addition a material reduction of 20% was possible. The use of cooling plates in accordance with the invention however made it necessary for more refractory lining material and some extra pipework to be required.

For each opening 3 in the shell 2 the cost saving for the blast furnace in question as about Dfl. 140. For the whole blast furnace, which has 2000 openings for cooling plates, this means a financial saving of about Dfl. 280,000 in addition to the achievement of an improved cooling capacity.

What is claimed is:

1. A coolable furnace wall structure comprising:

a steel shell, a refractory lining of the steel shell on the inside thereof, a plurality of spaced apart openings through the shell, recesses in the refractory lining corresponding to said openings, each recess extending inwardly from the respective opening and having a transverse width which increases away from the shell, for each said opening and corresponding recess, an assembly of at least two hollow cooling plates which are removably connected to the shell and extend from the shell into the recess and have supply and discharge openings for coolant, wherein at least a first one of said cooling plates of the assembly has a transverse width which does not increase away from the shell opening whereby that cooling plate can be removed first from the assembly through the opening and at least one other cooling plate of the assembly has a maximum transverse width which permits its removal through the opening after the removal of said first plate.

2. The wall structure according to claim 1 wherein the assembly of cooling plates substantially fills the recess and each said other cooling plate has a transverse width increasing away from the shell opening.

3. The wall structure according to claim 1 wherein the said assembly consists of two said cooling plates.

4. The wall structure according to claim 1 wherein, at its end adjacent the shell opening, each cooling plate has around it a steel band cast in place, these steel bands of the respective cooling plates of the assembly being joined by welding to each other at locations where they adjoin and there being a cover plate joined by welding to the shell and surrounding the assembly adjacent the shell opening to which said steel bands are themselves joined by welding.

5. The wall structure according to claim 4 wherein, at said locations where they adjoin each other, each said steel band projects from the cooling plate in the outward direction.

6. The wall structure according to claim 4 wherein at each location where two neighbouring cooling plates adjoin, a further sealing strip is joined by welding to said steel bands of the cooling plates and to said cover plate.

7. The wall structure according to claim 1 wherein said first cooling plate of the assembly has inside it a coolant passage which has a single out-and-back form having one outward run and one return run, and each said other cooling plate of the assembly has inside it a coolant passage which has a double out-and-back form having two outward runs and two return runs.

8. The wall structure according to claim 1 wherein the assembly consists of two cooling plates arranged for flow of coolant through them in series, the supply and discharge openings of the plates being arranged in a row and there being a coupling pipe for flow of coolant from one said cooling plate to the other connected to the two end openings of said row.

9. The wall structure according to claim 1 wherein each cooling plate has at least one eye for use in disassembly at its end adjacent the opening.

10. The wall structure according to claim 9 wherein the said first cooling plate has a said eye located in an outwardly extending cast projection, and each said other cooling plate has two said eyes located in opposed outward projections on a steel band which surrounds the cooling plate at its end adjacent the shell opening.

11. The wall structure according to claim 1, wherein the recess increases away from the shell opening in horizontal section and remains substantially constant in vertical section.

12. An assembly of cooling plates for use in a furnace wall structure comprising a first cooling plate having an end with supply and discharge openings for coolant, top and bottom parallel sides and two vertical sides which do not increase in distance therebetween in extending from said end and a second cooling plate having an end with supply and discharge openings, top and bottom parallel sides and two vertical sides which increase in distance therebetween in extending from said end of said second cooling plate, said discharge opening of one plate being connected to the inlet opening of the other plate.

* * * * *